United States Patent [19]

Beisty et al.

[11] 4,400,083

[45] Aug. 23, 1983

[54] ELECTROSTATIC PRINTER DRUM IMPROVEMENTS

[75] Inventors: James M. Beisty, Wayne; Robert J. Miller, Salford; Albert J. Romeo, Center Square, all of Pa.

[73] Assignee: Decision Data Computer Corporation, Horsham, Pa.

[21] Appl. No.: 307,499

[22] Filed: Oct. 1, 1981

[51] Int. Cl.[3] ..... G03G 15/00

[52] U.S. Cl. ..... 355/16; 355/3 DR; 355/3 BE; 15/21 E

[58] Field of Search ..... 355/16, 3 DR, 15, 3 BE, 355/3 R, 1; 346/153.1, 161; 242/67.3 R, 67.3 F, 192; 15/301, 15 R, 21 D, 21 E

[56] References Cited

U.S. PATENT DOCUMENTS

| | | | |
|---|---|---|---|
| 4,063,809 | 12/1977 | Schrempp et al. | 355/3 DR |
| 4,068,942 | 1/1978 | Pennell | 355/3 DR X |
| 4,097,138 | 6/1978 | Kingsley | 355/3 DR |
| 4,231,652 | 11/1980 | Moser et al. | 355/3 DR |
| 4,239,375 | 12/1980 | Eisbein et al. | 355/3 DR X |
| 4,252,435 | 2/1981 | Manghirmalani | 355/15 |
| 4,259,003 | 3/1981 | Mangal et al. | 355/15 X |
| 4,268,159 | 5/1981 | Tashiro | 355/3 R |
| 4,298,268 | 11/1981 | Sato et al. | 355/15 X |

*Primary Examiner*—A. C. Prescott

*Attorney, Agent, or Firm*—Charles H. Lindrooth

[57] ABSTRACT

Disclosed is an electrostatic printer having a rotatable drum with a photoreceptor belt mounted on the periphery. The photoreceptor belt is advanced past a cathode ray tube which forms an electrostatic image on its surface. A wiper brush is recessed within an opening extending transversely of the drum surface and is mounted for movement from the recessed position to a position in which it wipes the face of the cathode ray tube face as the drum is rotated. Also enclosed in conjunction with the wiper is a mechanism for periodically indexing the supply of photoreceptor web from a supply reel to a take-up reel both located interiorly of the drum. The photoreceptor is advanced by mechanism including planetary gearing.

8 Claims, 8 Drawing Figures

ELECTROSTATIC PRINTER DRUM IMPROVEMENTS

FIELD OF THE INVENTION

This invention relates to electrostatic printing and more particularly to improvements in corona discharge devices used in printers of the electrostatic type.

BACKGROUND OF THE INVENTION

As is well known in the art of electrostatic copiers, conventional technology of the type herein referred to involves uniformly charging a photoconductive insulating surface by moving the insulating surface past one or more d.c. corona discharge devices which are connected to a high voltage source and which include one or more thin wires to impart a uniform charge to the surface. This charge is thereafter selectively dissipated by exposure of the surface to a light pattern. The resulting electrostatically charged latent pattern or image is thereafter developed by application of an electroscopic material called toner through electrostatic attraction to form a visible image of toner particles corresponding to the electrostatic pattern. This pattern is subsequently transferred to paper or other medium on which the images are to be imprinted. At least one other corona device is conventionally used to effect transfer of the electrostatic image to the paper. This transfer may be effected by application of a charge to the back of paper. This charge is opposite to that of the toner particles and greater than that attracting the particles to the photoconductive medium so that a sufficient number of particles are attracted to the paper to produce a clear, sharp image.

An important problem in the use of such printers arises because of the need for maintaining an acceptable level of print quality over prolonged periods of time. This problem is particularly acute in output printers wherein an exceptionally large number of pages are reproduced. Quality of a level comparable to that produced by conventional electric typewriters is expected. For such machines to be of wide spread utility commercially the quality of the finished product must be maintained over relatively long periods of time without too many service calls.

One problem arises because of the tendency of toner particles to be attracted to the face of the cathode ray tube used for the formation of characters. A certain amount of toner particles is always in the environs of the machine and a particularly large amount may be present following paper jams or similar malfunctions.

A further problem is the gradual degradation of the photoreceptor material itself. Typical cadmium sulfide photoreceptors have a service life of approximately 25,000 copies. When used as an output printer 25,000 copies is not a satisfactory service life.

SUMMARY AND OBJECTS OF THE INVENTION

With the foregoing in view an important object of the invention is the provision, in an electrostatic printing machine, of a photoreceptor drum having novel means mounted internally of the drum for advancing a supply of photoreceptor material from a supply roll onto the drum surface for use in the making of photostatically reproduced prints, to a take-up roll on which used photoreceptor material is wound and means for periodically wiping the cathode ray tube face so as to remove toner particles attracted to the tube face.

Another object of the invention is the provision of a retractable wiper member mounted within the photoreceptor drum and mechanism for periodically moving the wiper member to a position in which the cathode ray tube face is cleaned.

A further object of the invention is an improved drive mechanism for advancing a web of photoreceptor material from a supply to a take-up roll carried by a rotary photoreceptor support member.

The foregoing and various objects are achieved in a rotating drum for advancing a photoreceptor plate mounted on the periphery thereof past an imaging station at which a cathode ray tube is positioned so as to project images of light and shadow onto the photoreceptor surface. The drum is provided with a recess in which a pair of rolls are mounted. One of the rolls has a supply of photoreceptor web wound thereon, the web extending from the supply roll through a transversely extending slot in the drum periphery, thereafter around the periphery through a second slot and onto a take-up roll. A drive gear mounted coaxially with the axis of rotation of the drum is frictionally interconnected so as to rotate conjointly with the drum. A planetary gear mounted on the drum meshes with the drive gear. It is provided to advance the photoreceptor web from the supply roll to the take-up roll upon rotation thereof about its own axis. Means are provided for periodically producing rotation of the drive gear relative to the drum so as to cause rotation of the planetary gear about its planet axis. The mechanism provides a simple and effective means for periodically indexing fresh portions of photoreceptor material onto the drum periphery so as to prolong the period before replacement of the photoreceptor web.

Another feature of the invention involves the provision of a novel wiper means which is movable from a position in which it is recessed within the drum adjacent the supply and take-up rolls for the photoreceptor web and is movable to a position within the plane of contact with the face of the cathode ray tube so as to clean the tube face of toner particles.

DETAILED DESCRIPTION OF THE ILLUSTRATIVE EMBODIMENT OF THE INVENTION

Figure 1:
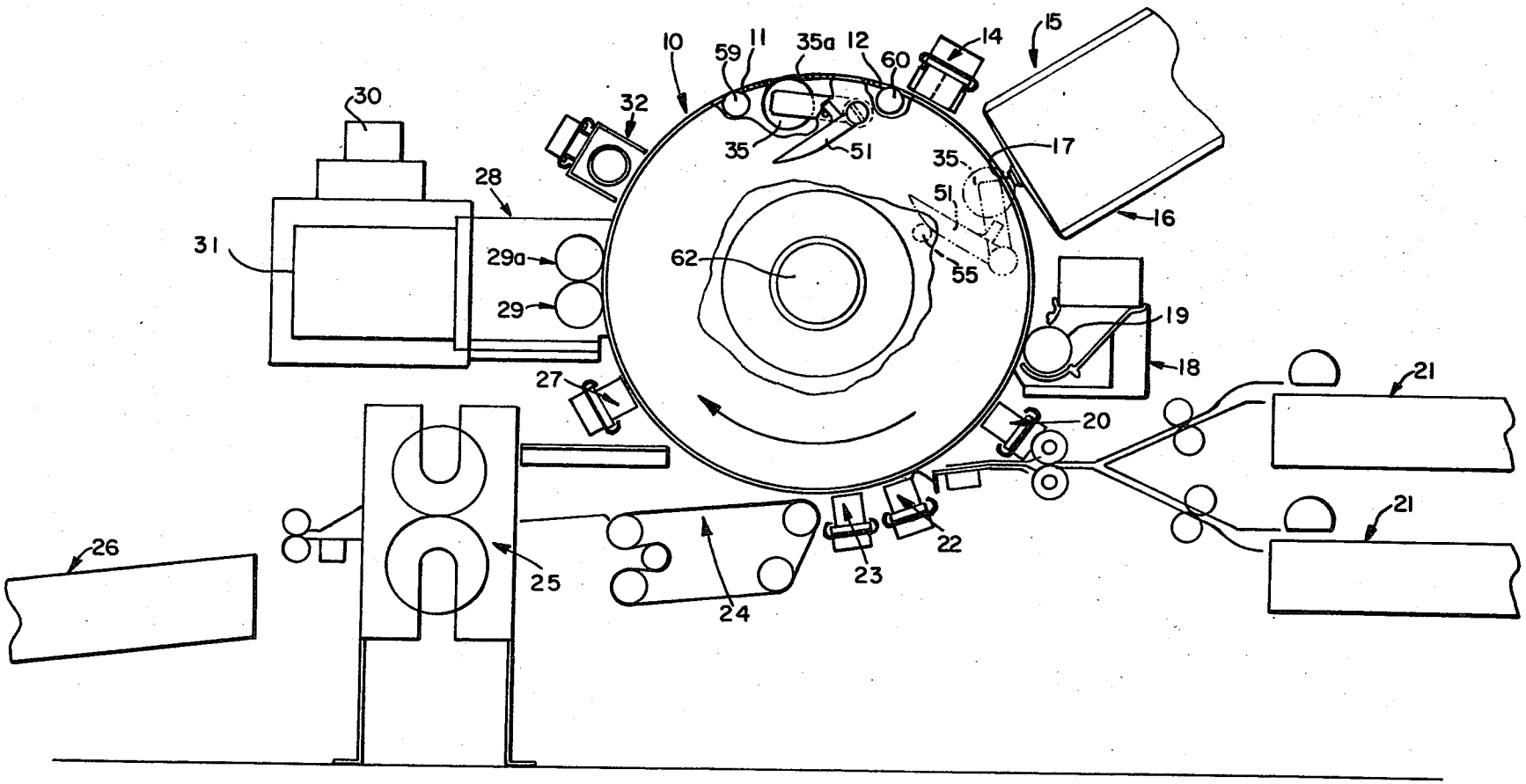
FIG. 1 is an overall view showing in schematic form, apparatus incorporating the principles of the present invention.
Figure 2:
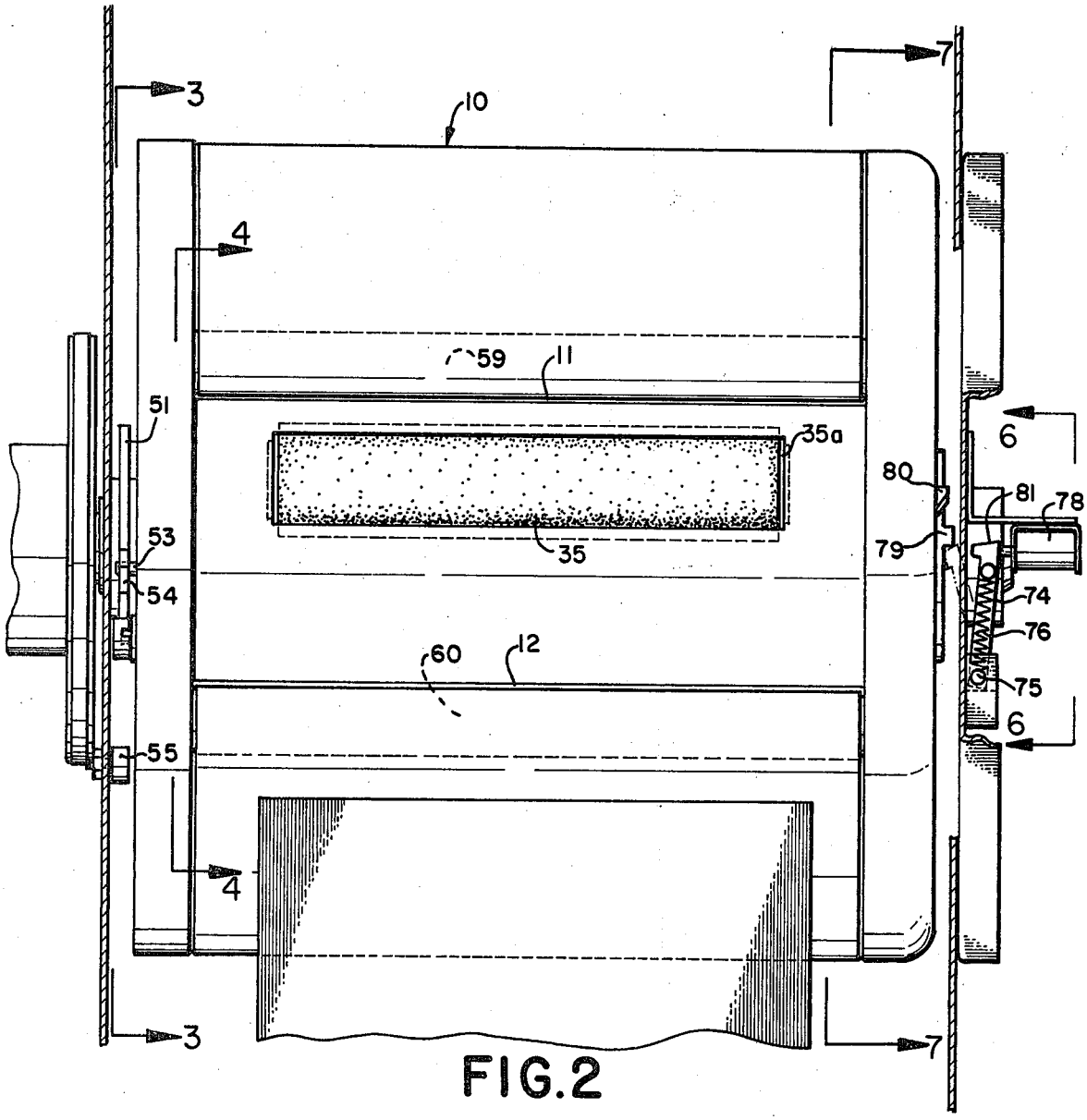
FIG. 2 is a plan view of a drum incorporating the principles of the invention.

Reference is first made to FIG. 1 which illustrates in schematic form a preferred form of printing device capable of printing data transmitted from a keyboard, a computer or remote communications device. As illustrated in FIG. 1, the apparatus comprises a rotatable drum 10. A web of a photoreceptor material is periodically fed through an opening 11 in the periphery of the drum. The web extends around a substantial portion of the periphery and is then fed through a second opening 12 where it is wound up on a take-up spool not shown in FIG. 1. The photoreceptor web is of known type comprising a photoconductive layer of insulating material such as cadmium sulfide applied over a conductive backing.

In use, the drum is indexed in the clockwise direction as shown in FIG. 1 first past a d.c. corona discharge device 14 which imparts a uniform charge to the photoconductive layer. The charged photoreceptor then passes by an image forming station 15 wherein a latent electrostatic image is formed on the photoreceptor. According to the invention the image is formed by a cathode ray tube 16 which is mounted with its tube face 17 closely adjacent to the photoreceptor. Successive line scans form an image on the photoreceptor by selectively discharging the photoreceptor in accordance with variations in the light patterns formed by the scans. The latent image is then developed as it passes a toner applicator station schematically shown at 18. In the illustrative embodiment, a magnetic toner is applied via a magnetic roller 19, and the toner particles are charged and attracted to oppositely charged areas on the photoreceptor. A visible image is thus formed on the photoreceptor.

The charged and toned image next passes a station where a pre-transfer corona 20 is located. The pre-transfer corona is a high voltage a.c. corona whose function is to facilitate transfer of the image by loosening the toner bond existing between the toner particles and the oppositely charged portions of the image.

Immediately following the pre-transfer corona, paper fed from one or another of a pair of paper cassettes 21 is fed into contact with the toned image bearing surface of the photoreceptor. A d.c. transfer corona 22 next places a charge on the back of the paper which exceeds the charge acting to bond the particles to the photoreceptor and is of opposite polarity to the particles, thereby transferring the toned image from the photoreceptor belt to the front of the paper. The section of photoreceptor then passes a detack corona 23 which is an a.c. corona whose function is to null out any charge existing on the paper thereby facilitating release of the paper from the surface of the drum. Thereafter the paper is transferred to a transfer belt 24 and fed between fuser rolls 25 wherein the image is fused by heat or pressure and delivered to an output tray 26. The drum then moves the photoreceptor past a pre-cleaner corona 27 which is an a.c. corona used for loosening toner. The portion of the photoreceptor with the loosened toner is next advanced to a clean-up station 28. A mechanical brush 29 located at the clean-up station brushes off the photoreceptor and a magnetic roller **29*a* aids in toner removal. The toner removed by the brush is drawn away from the photoreceptor surface by a vacuum motor 30 which draws the toner particles into a filter bag 31. The cleaned-up surface then passes by a burn-out lamp 32 which removes residual charge on the photoreceptor prior to its being recharged by the charge corona 14**.

According to the invention, means are provided for periodically wiping the face of the cathode ray tube so as to remove any toner particles which may have accumulated on the tube face. With reference to FIGS. 2 through 5, the cleaning means comprises a wiper roll or brush 35 which is mounted for movement from a position in which the roll is wholly inside the drum 10 to a position in which the roll extends beyond the surface of the drum into a plane in which it will contact and clean the face of the cathode ray tube as the drum rotates the brush. Preferably, the wiper is formed of soft felt or material having sufficient pile so that the tube surface is thoroughly yet gently wiped clear of any toner particles whenever it is moved past the tube face with the wiper in the active position.

In carrying out the invention the wiper roll 35 is carried by a pair of spring loaded arms 36 (FIGS. 4 and 5) which are mounted on the ends 38 and 39 of a shaft 40 for rocking movement with the shaft by means of transversely extending pins 37. A spring 41 urges the arms 36 and 37 towards one another so that they act to clamp the brush. The pin mounting of the arms provides for rocking movement with the shaft and permits them to be separated so as to replace the roll 35 as required. Preferably friction pads 42 carried by the arms bear against the sides of the roller to retard rotational movement of the roller.

According to the invention each of the arms is spring loaded by means of a pair of springs 43 and 44. The springs are preferably connected to the pins 37 and upstanding projections 46 located on each spring loaded arm. The spring loaded arms 36 permit some independence of movement of the ends of roller 35 so as to insure that it uniformly and completely wipes the entire tube face.

Figure 3:
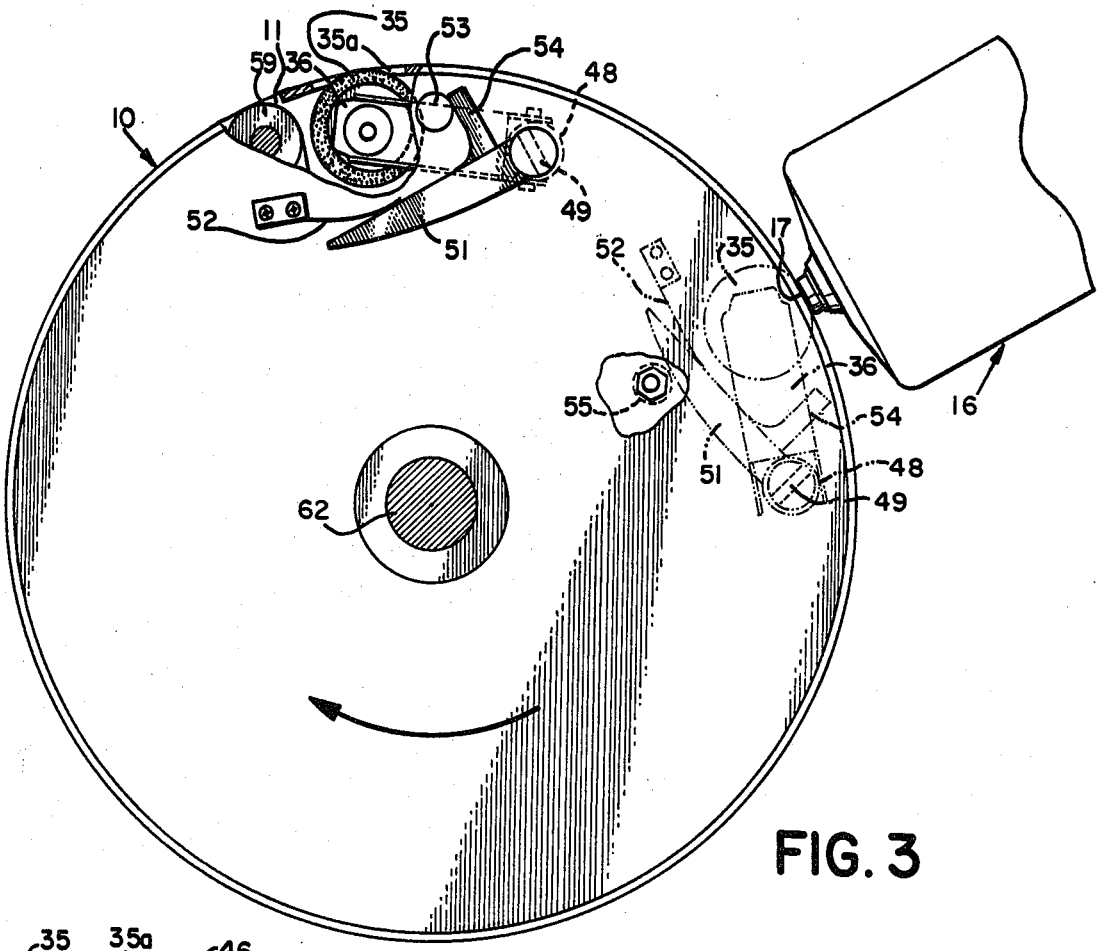
FIG. 3 is a sectional view taken along line 3—3 of the drum of FIG. 2.
Figure 4:
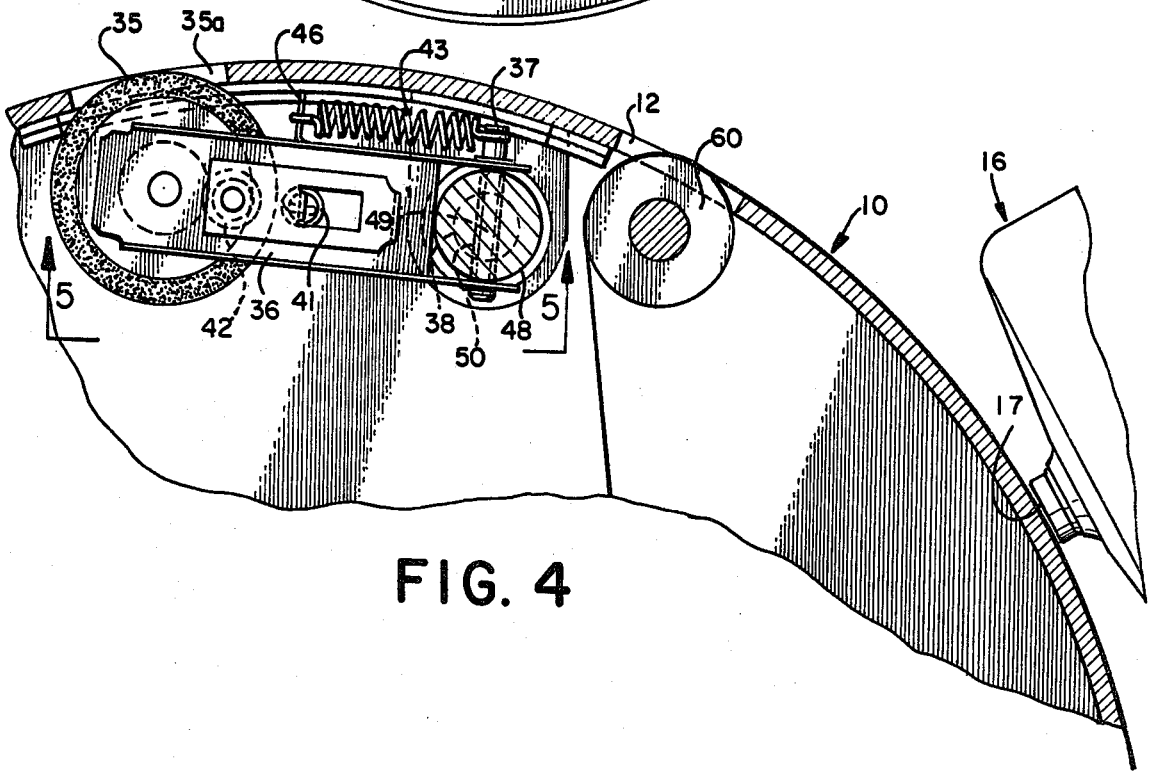
FIG. 4 is a sectional view taken along line 4—4 of FIG. 2, on an enlarged scale with respect to FIGS. 2 and 3.
Figure 5:
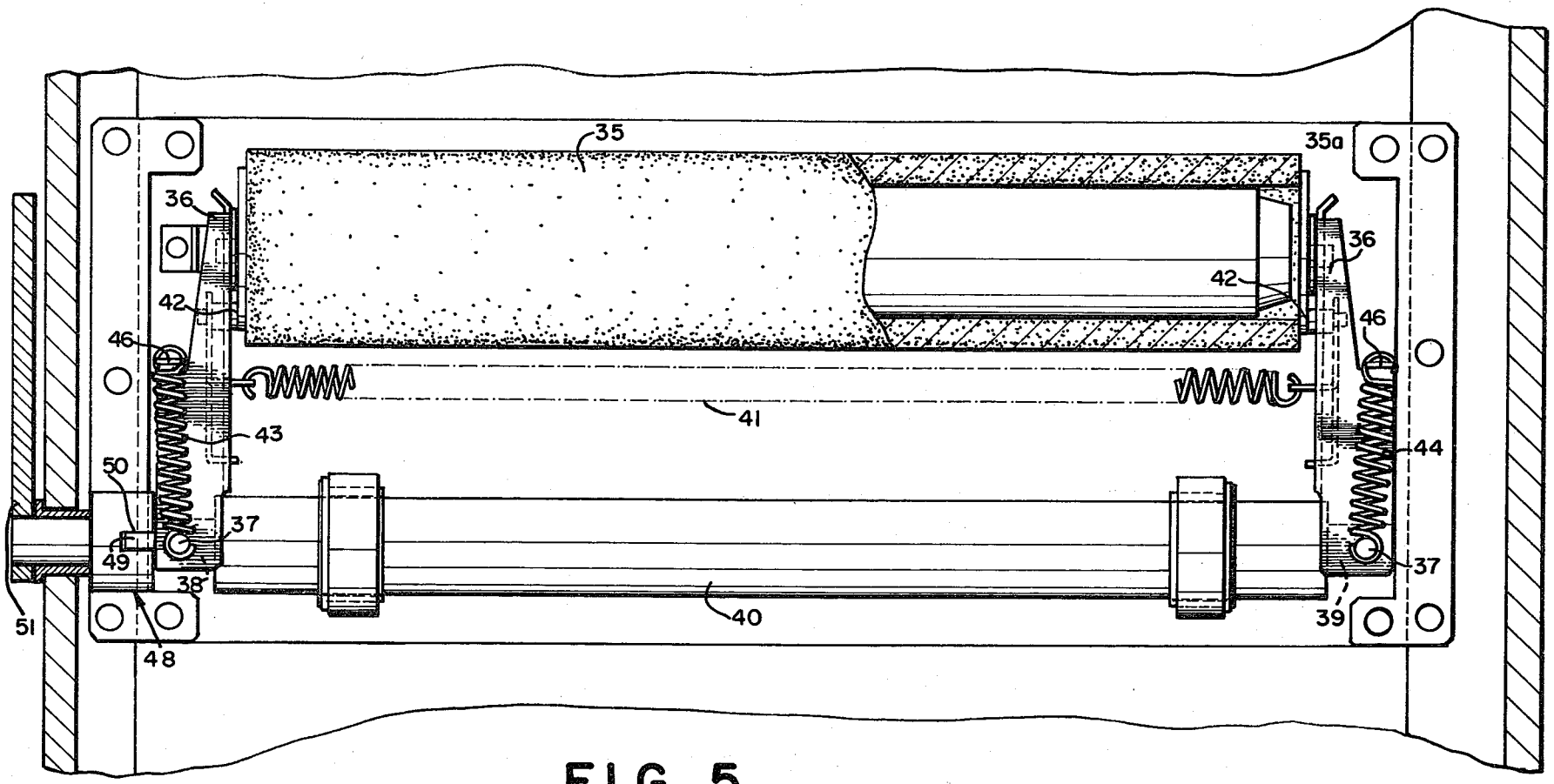
FIG. 5 is a sectional view taken along line 5—5 of FIG. 4.
Figure 6:
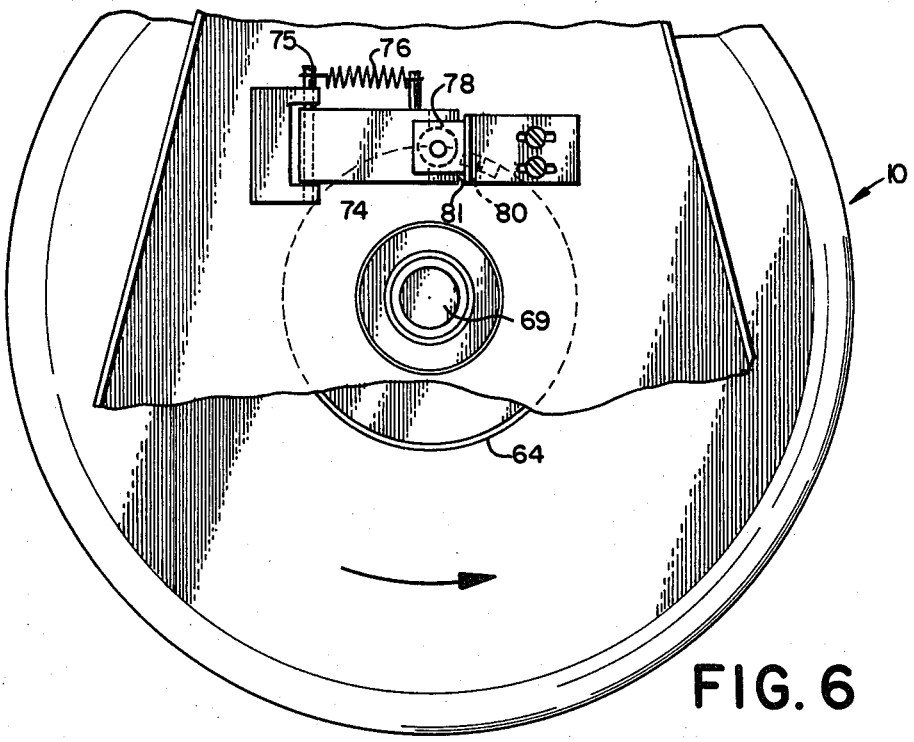
FIG. 6 is a sectional view taken along line 6—6 of FIG. 2.

A drive coupling 48 comprised of a projection 49 which fits within a slot 50 couples shaft 40 to a cam arm 51. As is shown in FIG. 3 cam arm 51 is spring biased to a position in which roller 35 does not project beyond the periphery of the drum by any suitable means such as a leaf spring 52 (FIG. 3). A pin 53 extending from the side of the drum 10 acts against a projection 54 on the cam arm 51 so as to limit the rotational movement of the cam arm and hence the degree to which the roller 35 is retracted.

Preferably, means are provided to move the wiper roller 35 to the activated position in which it wipes the face of the cathode ray tube once during each rotation of drum 10, thereby insuring that the tube will be wiped clean after no more than two prints have been made. In the preferred embodiment of the invention, activation of the wiper roll is accomplished by a cam roller 55 which is secured on the machine frame in the path of travel of the cam arm in position to rock it once each cycle of rotation thereby moving the wiper roller to the activated position as the roller nears the face of the cathode ray tube. As soon as the roller moves beyond the face, the cam arm moves off the cam roller 55 and the wiper roller is retracted by action of the leaf spring 52. For purposes of illustration, the positions of the parts when the roller is at the cathode ray tube station are shown in broken lines in FIGS. 1 and 3.

Figure 7:
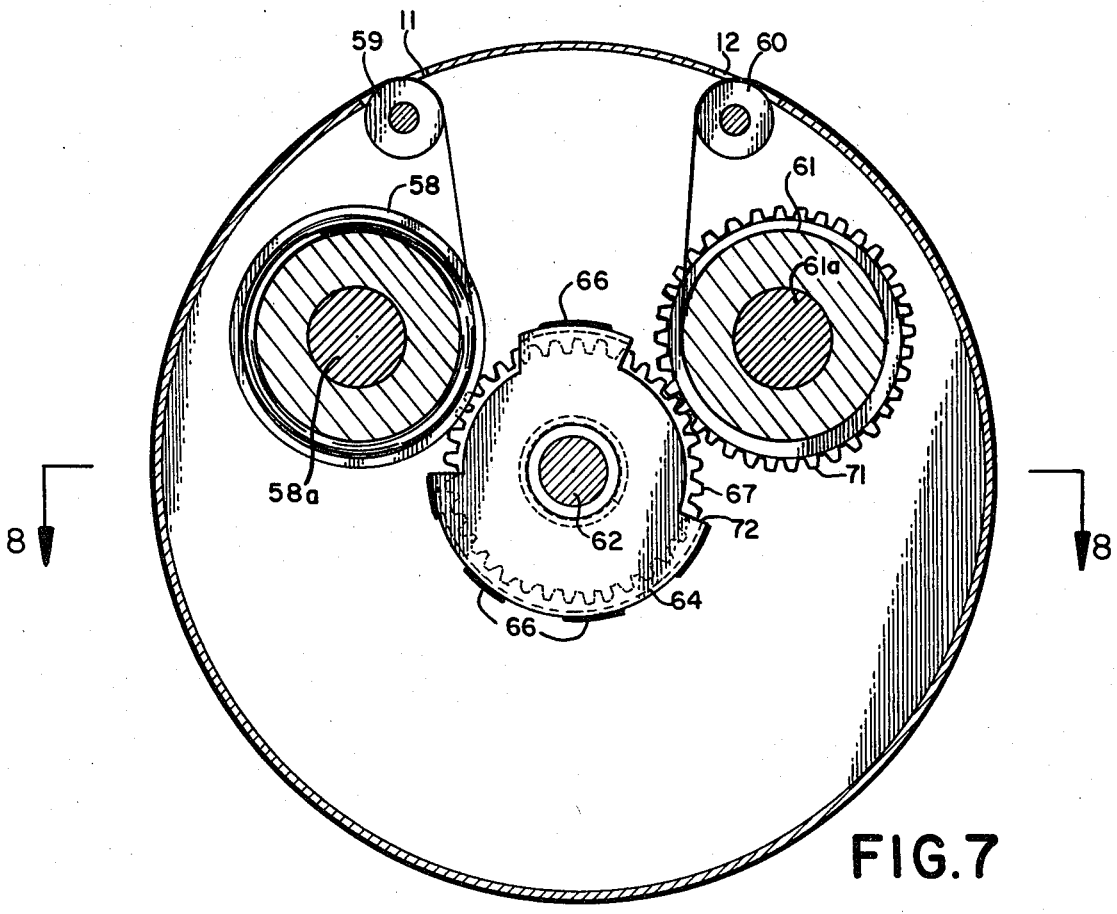
FIG. 7 is a sectional view taken along line 7—7 of FIG. 2.

Turning now to FIG. 7, the photoreceptor web or master is shown as extending from a full supply roll of photoreceptor web material located interiorly of the drum as shown at 58. The web extends around a guide roll 59 located adjacent to the periphery of the drum and from that roll around a substantial portion of the drum periphery. The photoreceptor web then passes over a second guide roll 60 to a take-up roll 61 also located interiorly of the drum. The supply roll and take-up roll are rotatably mounted on shafts 58*a* and 61*a* which are fixed to the side wall of the drum.

Figure 8:
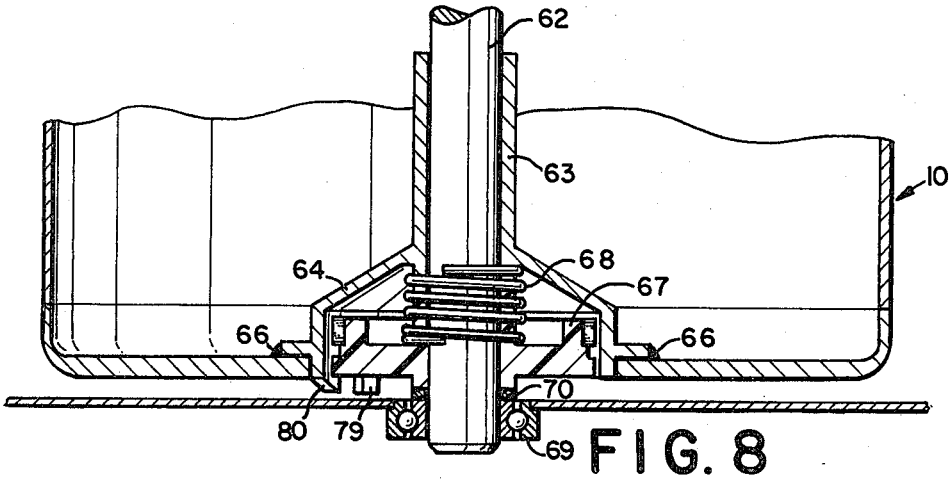
FIG. 8 is a sectional view taken along line 8—8 of FIG. 7.

The means for periodically advancing the photoreceptor web is best seen upon reference to FIGS. 7 and 8. Turning first to FIG. 8, drive shaft 62 for drum 10 carries a sleeve 63 having an enlarged hollow end portion 64 which is welded or otherwise secured to the drum by any suitable means such as tack welds shown at 66. A drive gear 67 is mounted on the shaft. A clutch spring 68 urges the drive gear 67 against the rotatable portion of shaft bearings 69. A pad of frictional material 70 forms a frictional clutch so that the gear rotates conjointly with the shaft and the drum.

A planetary take-up gear 71 is connected to take-up reel 61 for rotation therewith on shaft 61*a* and is in mesh with drive gear 67 through a cut out 72 in housing 64 as is best shown in FIG. 7.

With the mechanism so far described, gear 67 rotates conjointly with the drum 10 via shaft 62 and consequently there will be no rotation of planetary gear 71 about its planet axis. Relative rotation of the gear 67 with respect to the shaft and the drum causes rotation of the planetary gear 71. This relative rotation is preferably achieved by a lock pawl 74 which is pivotally mounted at 75 to the printer frame and held in either a retracted position shown in full lines in FIG. 2 or in a phantom line position by means of an over center toggle spring 76. A solenoid 78 moves the lock pawl from the full line position to the phantom line position. In this position a locking surface 81 on the lock pawl is in the path of a locking tab 79 located on the outer face of gear 67. When the locking pawl is activated by solenoid 78, the gear moves into a position in which the lock tab and the locking surface 77 of the pawl interengage. Thereafter, the drum continues its rotation whereas the gear 67 is held against rotation. This causes rotational movement of planetary gear 71 about its planetary axis thus causing the take-up reel 61 to rotate in the direction shown by the arrow in FIG. 7 so as to take up a section of used photoreceptor web, replacing it with fresh photoreceptor material from supply roll 58. As the drum continues its rotation relative to the lock pawl 74, a release tab 80 located on the face of the drum moves into a position of engagement with a release surface 81 on the pawl. The release tab cams the locking pawl outwardly out of engagement with the lock tab 79. When the lock pawls move beyond the over center position of spring 76, the pawl returns to the full line position shown in FIG. 2. Tensioning means are provided (not shown) to maintain web tension after windup.

In a preferred form of the invention the amount of photoreceptor material exposed on the periphery of the drum is of a length of approximately 36 lineal inches so that two legal sized pages may be printed successively during each rotation of the drum. Preferably the diameters of the spools are large enough so that one revolution of the drum indexes an amount of photoreceptor sufficient to replace what has been previously exposed on the drum periphery. Assuming that any part of the photoreceptor web is capable of receiving an image 25,000 times before copy quality is materially impaired the material on the periphery should be replaced with new material from the supply reel 58 after a total of approximately 50,000 prints are made. The machine logic includes a switch for activating solenoid 78 to advance the photoreceptor belt the required amount whenever the predetermined number of copies have been made.

We claim:

1. An electrostatic printer having a rotatable drum for advancing a photoreceptor mounted on the periphery thereof past a plurality of stations, a cathode ray tube positioned at one of said stations, said tube having its face located adjacent the periphery of said drum to project line scan images of light and shadow onto said photoreceptor whereby composite latent images are formed by the projection of successive scan images onto the photoreceptor, said printer further comprising an applicator located in the path of rotation of the drum for the application of toner in particulate form to the latent images formed by said cathode ray tube, an opening in the periphery of said drum, a wiper recessed within said opening, said wiper being mounted for movement from said recessed position to a position in which it extends beyond the periphery of the drum into a plane of contact with said means for periodically moving said tube face and means for periodically moving said wiper into said plane of contact for periodically wiping said tube face.

2. An electrostatic printer according to claim 1 wherein said wiper comprises a wiping roller extending transversely to the direction of movement of said drum.

3. An electrostatic printer according to claim 2 further including cam means for periodically moving said roller into the plane of contact as the roller approaches the cathode ray tube station and for retracting the roller as the roller passes the cathode ray tube station.

4. An electrostatic printer according to claim 3 further including means biasing said roller to the retracted position.

5. An electrostatic printer having a rotating drum for advancing a photoreceptor web mounted on the periphery thereof past an image station, means at said imaging station for projecting images of light and shadow onto said photoreceptor, said drum having a recess in the periphery thereof extending transversely of the path of rotary movement thereof, a pair of reels mounted within said recess, one of said reels being adapted to receive a supply of photoreceptor web wound thereon, said web extending from said supply roll out of said recess and around the periphery of said drum to the other of said reels, a web drive gear mounted coaxially with the axis of rotation of the drum, a friction clutch for effecting conjoint rotation of said web drive gear and said drum, a planetary gear mounted on said drum, said planetary gear being in mesh with said web drive gear, said planetary gear being adapted to rotate one of said reels upon rotation thereof about its own axis whereby the supply of photoreceptor web is advanced from said supply reel and taken up on said other reel, and means for periodically restricting rotation of the web drive gear relative to said drum thereby causing rotation of the planetary gear about its own axis.

6. A printer according to claim 5 further including a counter and means actuated by said counter for actuating said means for producing rotation of the drive gear relative to said drum following production of a predetermined number of imprints.

7. An electrostatic photoreceptor drum according to claim 5 further including a wiping device located interiorly of said recess, said wiping device being mounted for movement from a recessed position wherein the wiper device is located interiorly of the drum periphery to a position in which it extends beyond the drum periphery into a plane of contact with said tube face and wiper actuating means operable as the recessed wiper is rotated to a position adjacent the tube face for moving the wiper into said plane of contact whereby the tube face is cleaned as the wiper moves across the tube face, said wiper actuating means being operable to return said wiper to the recessed position when the wiper moves beyond said tube face.

8. A printer according to claim 7 wherein said actuating means comprises a cam arm connected to said wiper and a cam actuater fixed adjacent said cathode ray tube station and interengageable with said cam to move said wiper to said position of wiping contact with said tube face during each rotation of said drum.

* * * * *

UNITED STATES PATENT AND TRADEMARK OFFICE

CERTIFICATE OF CORRECTION

PATENT NO. : 4,400,083

DATED : August 23, 1983

INVENTOR(S) : Beisty et al.

It is certified that error appears in the above—identified patent and that said Letters Patent is hereby corrected as shown below:

Col. 6, line 43 "image" should read --imaging--

Signed and Sealed this

*Thirteenth* Day of *March 1984*

[SEAL]

*Attest:*

GERALD J. MOSSINGHOFF

*Attesting Officer*

*Commissioner of Patents and Trademarks*